United States Patent [19]

Mood

[11] Patent Number: 4,662,258

[45] Date of Patent: May 5, 1987

[54] MEANS AND METHOD FOR BEVEL CUTTING

[75] Inventor: Steven Mood, Lowell, Mass.

[73] Assignee: Winchester Corporation, Littleton, Mass.

[21] Appl. No.: 733,394

[22] Filed: May 10, 1985

Related U.S. Application Data

[63] Continuation of Ser. No. 391,492, Jun. 24, 1982, abandoned.

[51] Int. Cl.[4] ..... B26D 5/04; B26D 5/12

[52] U.S. Cl. ..... 83/455; 83/375; 83/614; 83/380; 83/581

[58] Field of Search ..... 83/455, 614, 380, 581, 83/375, 364

[56] References Cited

U.S. PATENT DOCUMENTS

| | | | |
|---|---|---|---|
| 3,044,508 | 7/1962 | Sherman | 83/380 X |
| 4,098,160 | 7/1978 | Weil | 83/614 X |
| 4,150,596 | 4/1979 | Short | 83/380 X |
| 4,187,755 | 2/1980 | Shirai | 83/614 X |
| 4,249,437 | 2/1981 | Hagenson | 83/364 X |
| 4,411,183 | 10/1983 | Auer | 83/614 X |

*Primary Examiner*—Donald R. Schran

*Attorney, Agent, or Firm*—Wolf, Greenfield & Sacks

[57] ABSTRACT

An automated means and method for cutting matte board and other soft materials. A matte board having a front display surface and spaced rear surface is placed on a planar support in facing contact with the display surface. After the matte is fixed into position, at least one cutting blade is caused to initially move simultaneously in both a vertical and horizontal direction to make a bevel cut from the rear surface through to the front surface. Once the cutting blade has passed through the front surface, the blade is caused to move horizontally so as to form a bevel cut along a predetermined length of the matte board.

8 Claims, 15 Drawing Figures

MEANS AND METHOD FOR BEVEL CUTTING

This application is a continuation of application Ser. No. 391,492, filed June 24, 1982 now abandoned.

BACKGROUND OF THE INVENTION

1. Field of the Invention

The present invention relates to a bevel cutting device and more particularly to a device which can accurately and repetitively produce decorative bevel cuts in picture frame matte board and other materials.

2. Brief Background of the Invention

One of the significant problems confronting picture frame manufacturers and frame shop operators is the cost associated with producing high quality decorative bevel cut picture frame mats. Bevel cut matte boards are preferred over straight cut boards because the bevel cut is more attractive and adds a sense of depth to the display picture. A bevel cut matte board not only highlights the beauty of an expensive frame but can also enhance the appearance of an otherwise unattractive and often inexpensive frame. For this reason, manufacturers of inexpensive picture frames often prefer to use the bevel cut matte board. Unfortunately, most manufacturers are deterred from using bevel cut matte boards because they are too expensive and not reasonably available in production quantities.

At the present, most bevel cut matte boards are produced on hand-drawn devices. These devices are unable to reasonably produce bevel cut mats in production quantities. Very often, the maximum output from such hand-operated devices are between 75 and 100 mats per hour. In practice, due to the calibration and adjustment time needed by these devices and the high amount of scrap boards caused by operator error, the rate is often much lower.

Both the manual devices and a few automated bevel cutters that are now on the market are often unable to produce museum quality bevel cuts. There are numerous inherent quality problems with these devices. They require the insertion of a cutting blade into a matte board and the subsequent movement of the blade through the board. The insertion or punching of the cutting blade into the matte board is commonly now accomplished by moving the blade downward in a single linear motion. Typically, the blade extends through the matte board into the work surface beneath the matte board by approximately 1/32 of an inch. As a result, the tip of the blade is anchored or compressed into the work surface while another portion of the blade is in the matte board. This can cause the cutting edge of the blade to be bent or warped. As the blade is later drawn through the matte board, an uneven, wobbling cut is often produced because of the flexure of the cutting blade. The cut does not become uniform until the blade is straight.

In addition, there are other problems associated with the insertion or punching of a cutting blade into the matte board as commonly now done in the art. Since the blade is essentially pushed through several layers of matte board, the blade will often draw the top color layer into the interior portion of the board. This can produce a cut that appears to be uneven in color and size. There is a also a problem of tearing or pinching the corners of a matte board because the punching of the blade tends to separate the layers or fibers of the board and causes a layer to tear from the board.

These quality problems are, to a certain extent, compounded because of the manual operation of these machines. The punch or insertion process of the blade is normally accomplished by having an operator manually press the blade into the matte board. Usually, the blade is attached to a lever type device wherein the arm of the lever is punched or pressed with the result that the blade enters the work piece. Since this is a manual operation, the amount of pressure applied to the blade varies from stroke to stroke. Ordinarily, the operator is not technically sophisticated which can lead to problems in accurately aligning and calibrating the cutter and also presents problems and errors during the punching and drawing of the blade through the work piece. Thus, the combination of operator error and the inadequacies of the cutter themselves often cause a fairly low quality bevel cut matte board.

There is a need in the market for a machine that can accurately produce high quality bevel cut matte board in production quantities. This machine should be able to cut matte board with minimum setup and maintenance and should be conducive to operation by an unskilled operator.

The present invention is capable of producing very high quality, so-called museum quality, bevel cut mats in production quantities with minimum setup and calibration time. Since the machine can produce several hundred mats per hour, the labor costs associated with each matte is minimal. As will be seen in greater detail below, the inadequacies associated with the punching of the blade through the work piece have been eliminated, and the tearing, color draw, and uneven cut problems have been solved.

3. Description of the Prior Art

Prior art matte cutting devices are generally jigs for holding blades that are manually manipulated once angles are preset by such jigs. For example, in Wheeler U.S. Pat. No. 513,851, mitering knives are held by a clamping jaw device at an angle whereupon the knives are manually drawn along a straightedge guide to effect a bevel cut in a matte board. In the Childs U.S. Pat. No. 534,061, a device for cutting circular openings in picture mats is disclosed. The cutting blade $n^3$ is inclined inwardly to the matte board so that a beveled edge is cut. The Murdoch cutter disclosed in U.S. Pat. No. 571,677 is a device for moving a cutting edge downward into a matte board at any desired beveled angle. Likewise, the devices disclosed in U.S. Pat. Nos. Eno 3,130,622; Keeton 3,213,736; Shapiro 3,463,041; Ellerin 3,527,131; McBride 3,768,357; Matthew 3,774,495; Broides 3,779,119; Stowe 3,973,459; Logan 3,996,827; and Jones 4,022,095 are bevel cutters which require the manual operations of blade insertion and draw along a guiding edge.

SUMMARY OF THE INVENTION

The present invention is an automated means and method for cutting matte board and other soft materials. A matte board having a front display surface and spaced rear surface is placed on a planar support surface in facing contact with the display surface. After the matte is fixed into position, at least one cutting blade is caused to move towards and through the display face from the rear surface to form a bevel cut. The cut is made to start and stop at a predetermined space from the edges of the matte board.

The cutting edge of the blade moves both vertically and horizontally as the edge is moving from at least the rear surface through to the display face. Once the cutting edge has pierced the display face by a predetermined amount, there is no further vertical movement of the blade but instead the blade moves horizontally through the matte board. The bevel cut is made for a predetermined length whereby the blade is withdrawn from the matte board while the cutting edge is moving both horizontally and vertically. As a result of this blade movement, the problems associated with the punching or insertion of the cutting blade in prior art devices is virtually eliminated and the quality of the bevel cut obtained from the present invention is of museum quality.

The bevel cutting machine comprises a work surface upon which the material to be cut is placed, a cutting arm housing which supports and positions the blade holders, a guiding surface on which the cutting arm housing moves, and a drive means which causes the cutting arm housing to move across the work material. The drive means and blade holders are activated by a source of power such as pneumatic power. In addition, there are positioning arms which position and upon activation clamp the work piece to the work surface immediately prior to activation of the cutting cycle. As will be described below, although pneumatic power is employed in the preferred embodiment, other forms of power, such as electric or hydraulic, can be used to effect the clamping and cutting cycles.

In operation a work piece is placed display face down on the work surface and positioned against positioning tabs. For the purpose of this description, the blade holders are assumed to be adjusted for the proper size cut. This step will be described in greater detail below. Upon activation of the clamping cycle, several clamps located near the work surface clamp the work piece to the surface. When the cut cycle is initiated, the cutting housing is caused to move along the guide means while the blade holders simultaneously cause the blades to move downward to engage the work piece. Thus, as the cutting edge of the blades enter the work piece, the edge is following an angular path. By doing so, the problems inherent in the prior art devices which result from the punching of the cutting blade into the matte board are virtually eliminated. The cutting blade passes through the matte board at a controlled rate until it cuts through to the front side of the board. Since the rate of entry is controlled, the blade is more capable of staying straight and producing a uniform cut than possible in the prior art methods. Further, the overcut appears on the back side of the board and is controlled.

In a preferred embodiment, two parallel cuts are made at the same time. It can be appreciated that more cuts can be made by merely adding blade holder and cutter housing assemblies. The blades are withdrawn from the work piece and the cutter housing is returned to its original position upon contact with a micro switch located on the guide means. The work piece is then removed and processed again to complete the two additional cuts necessary to complete a four-sided bevel cut of the matte board. Thus, by placing a work piece on a work surface, the present invention automatically, upon activation, clamps the piece, cuts at least two parrallel sides, and withdraws to its original position.

It is an object of the present invention to provide an automated cutter which is capable of producing several hundred "museum quality" bevel cut matte boards per hour.

It is another object of the present invention to provide an improved matte cutter in which consistent, straight line cuts are achieved and in which the cutting accuracy is such that the corners of the cut are clean without tears or pinches in the matte board stock.

Another object of the present invention is to have an automated matte cutter which does not draw the color of the outer layer of matte board stock into the center portion of the stock.

Another object of the present invention is to provide a matte cutter which can be accurately and quickly adjusted to cut stock of varying thickness, density, and size and for different bevel angle settings.

Still another object of the present invention is to have a bevel cutter which requires minimal maintenance to maintain production output.

A further object of the present invention is to be able to produce production quantities of bevel cut matte board while reducing the energy and labor costs associated with each cut matte board.

A further object of this invention is to provide a novel and advantageous method of bevel cutting mats rapidly and efficiently in automated equipment.

BRIEF DESCRIPTION OF THE DRAWINGS

The exact nature of the invention, as well as other objects and advantages, will be readily apparent from consideration of the following specification and the following drawings.

DETAILED DESCRIPTION OF THE INVENTION

Figure 1:
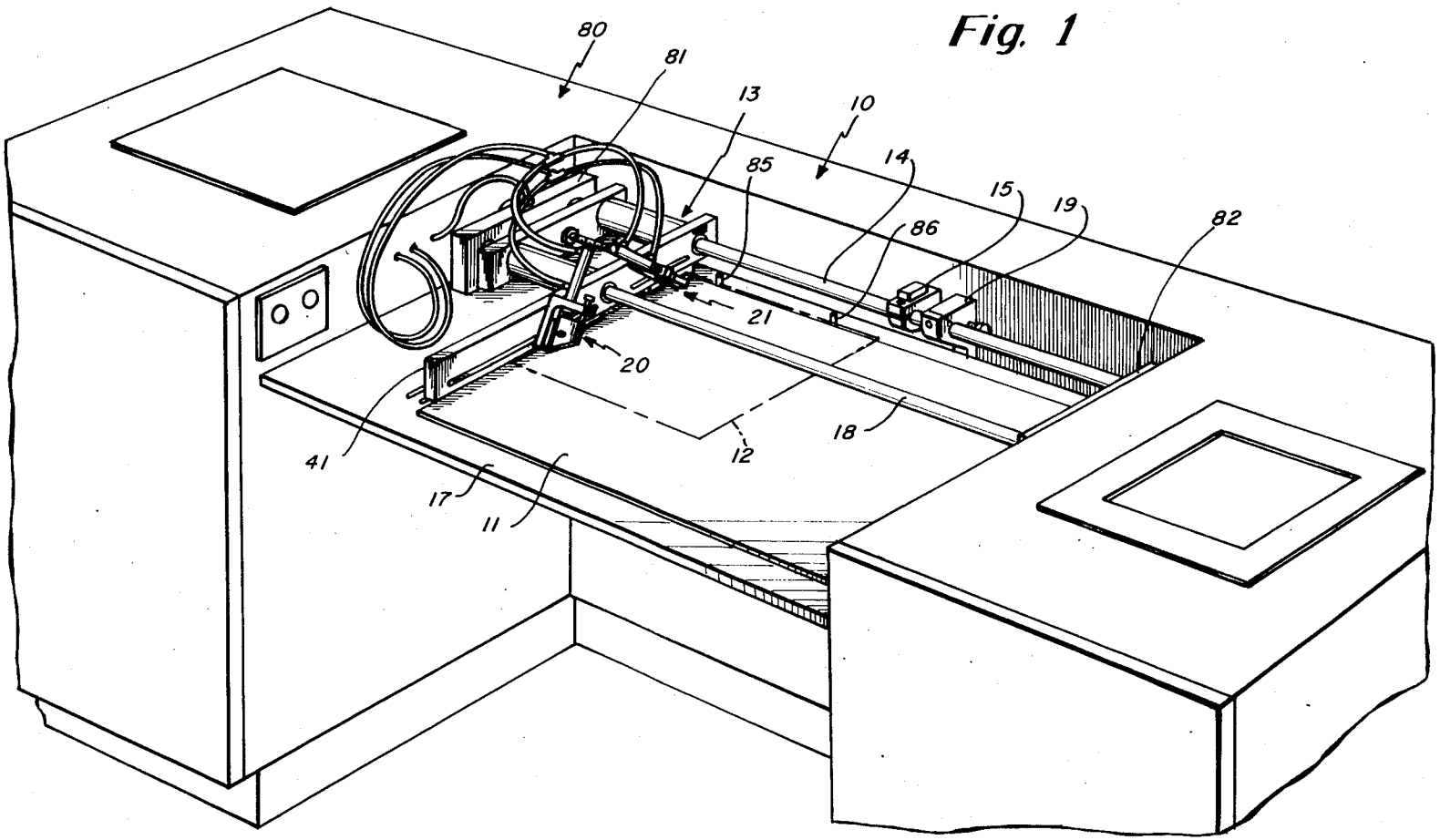
FIG. 1 is a perspective view of the present invention bevel cutter machine shown arranged for bevel cutting of two of the four sides of a matte board.

In FIG. 1 a preferred embodiment of an automatic bevel cutting machine 10 is shown. It comprises a pair of blade holder assemblies 20 and 21 mounted upon cutter arm housing 13 which is slidably mounted upon guide bars 14 and 18. On guide bar 14 is mounted a limit switch 15 and bracket arm 19. The above-recited structure is supported by a base plate 17 upon which a work surface 11 is placed. A work piece 12 is shown in phantom placed in a cutting position upon work surface 11.

Typically, work surface 11 is a self-healing plastic which is capable of receiving repetitive blade insertions with minimal damage. The machine 10 is shown supported by a cabinet 80 which stabilizes the work base 17 and provides storage for the various pneumatic power devices which drive the various moving parts of the machine 10. These devices are set up to power the machine by use of well-known pneumatic techniques.

Figure 2:
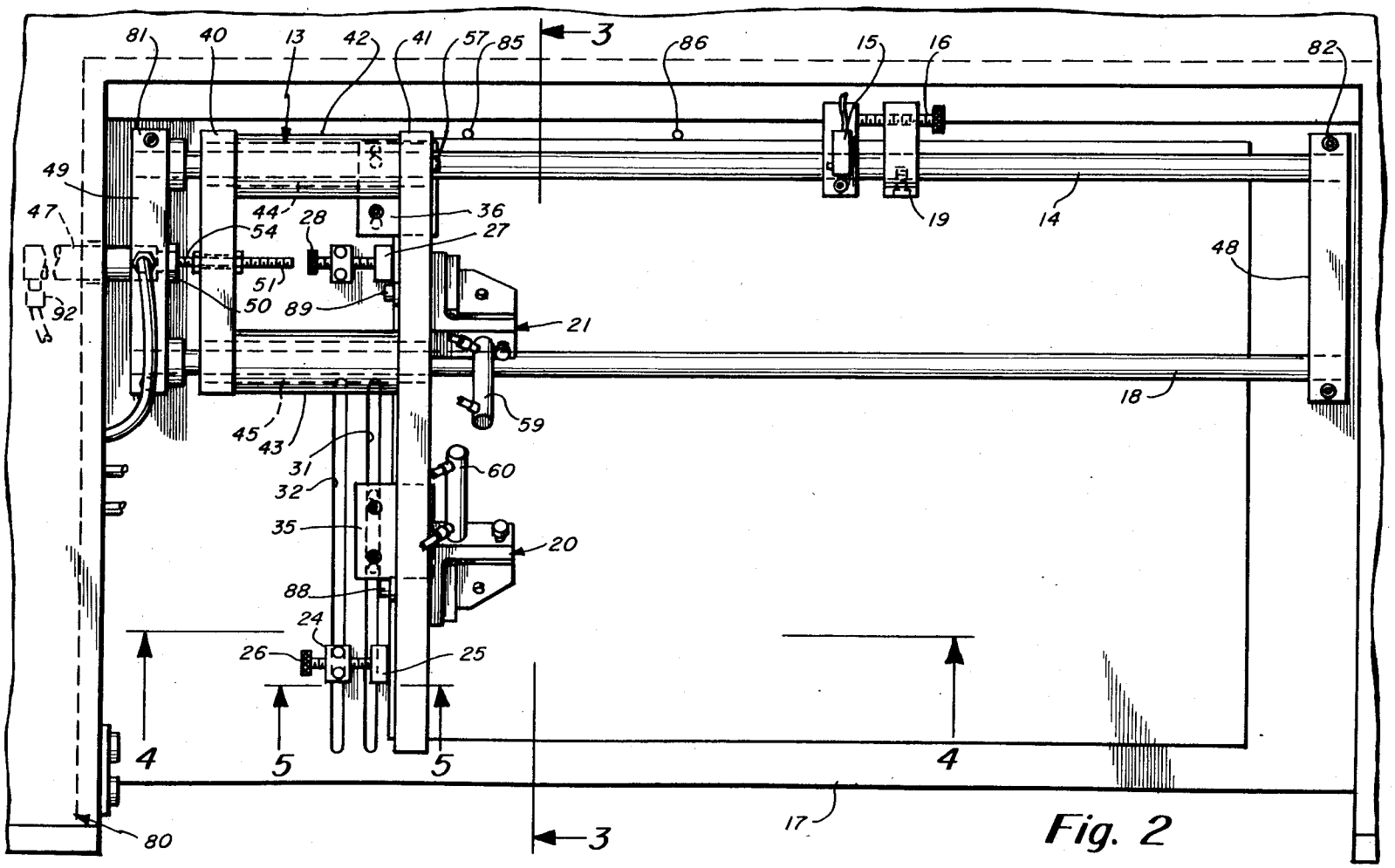
FIG. 2 is a top view of the bevel cutter machine showing the cutter housing assembly in its rest position.

The machine can be seen in greater detail in a top view as shown in FIG. 2. The cutting arm housing 13 is shown to be in the shape of a backward "P." It contains long housing arm 41 and short housing arm 40 mounted in a parallel and confronting position to each other. Connecting arms 41 and 40 are cylindrical arms 42 and 43 which are substantially parallel and confronting to each other. Contained within each cylindrical arm 42 and 43 are sleeve bearing 44 and 45, respectively. The bearings 44 and 45 extend into holes in arms 40 and 41 so that the entire cutting arm housing 13 can smoothly glide along guide arms 14 and 18. In addition, the bearings 44 and 45 are dimensioned so that there is minimum play between the bearings and guide arms 14 and 18. As such, the vertical movement of housing 13 is minimized with the result that the cutting accuracy of the machine is enhanced. It can be seen by those skilled in the art that the guide arms 14 and 18 can be positioned differently to provide greater stability to the unit. For example, guide arm 18 can be positioned further away from guide arm 14 or beneath the work surface 17.

The guide arms 14 and 18 are supported at the outer ends by support brackets 81 and 82. Passing through support bracket 81, which is adjacent to cutting arm 13 in its rest position, a piston 50 is contiguous with threaded shaft 54. The shaft 54 is threaded into the confronting end of piston 50 so that movement of piston 50 causes movement of the cutting arm housing 13. The air cylinder which causes the piston to move in and out is shown in phantom as cylinder 47. Flow regulation valve 92 on inlet line 93 to cylinder 47 adjusts the speed at which the piston 50 will move. It has the additional advantage of eliminating a spongy or soft movement by the piston 50. Thus, the cutting arm housing 13 is caused to move crisply from its rest position (shown in FIG. 2) to its cutting position and back by the movement of piston 50. As will be seen below, the length of the cutting cycle and the initiation of the return of the cutting arm housing 13 to the rest position is determined by the position of limit switch 15.

Figure 5:
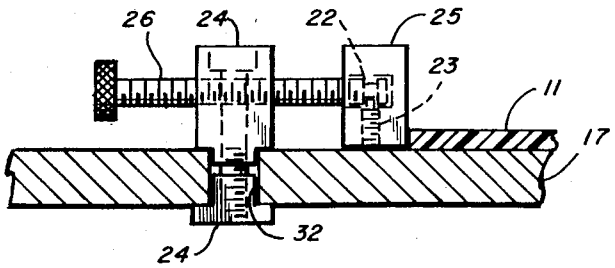
FIG. 5 is a front section view of the bevel cutter machine showing a work piece stop and adjustment screw taken along section line 5—5 in FIG. 2.

Posts 25 and 27, as well as posts 85 and 86, can be seen in FIG. 2. These posts are used to provide proper positioning to the work piece 12 when placed upon the work surface 11. In the embodiment shown, posts 85 and 86 are fixed while posts 25 and 26 are adjustable. In FIG. 5 the adjustable thumb screw 26 is shown for post 25. Slide column 24 is shown mounted in slot 32 so that a clockwise movement of screw 26 causes the post 25 to be secured in a desired position. Post 25 is shown to contain pin 23 which anchors the post to the screw. Column 24 when secured into slot 32 makes post 25 immovable for normal machine usage.

Also shown in FIG. 2 are clamp assemblies 35 and 36. These assemblies, when activated, clamp the work piece 12 to the work surface 11. The clamps 35 and 36 are activated immediately prior to the insertion of the cutting blades 70 and 71 into the work piece. As such, while the cutting blades 70 and 71 are moving through the work piece 12, the work piece is clamped to the surface 11 so that the cut is accurate and clean. Upon completion of the cut cycle, clamp assemblies 35 and 36 are deactivated and return to their normal position. The work piece 11 can then be removed and replaced with another.

Figure 3:
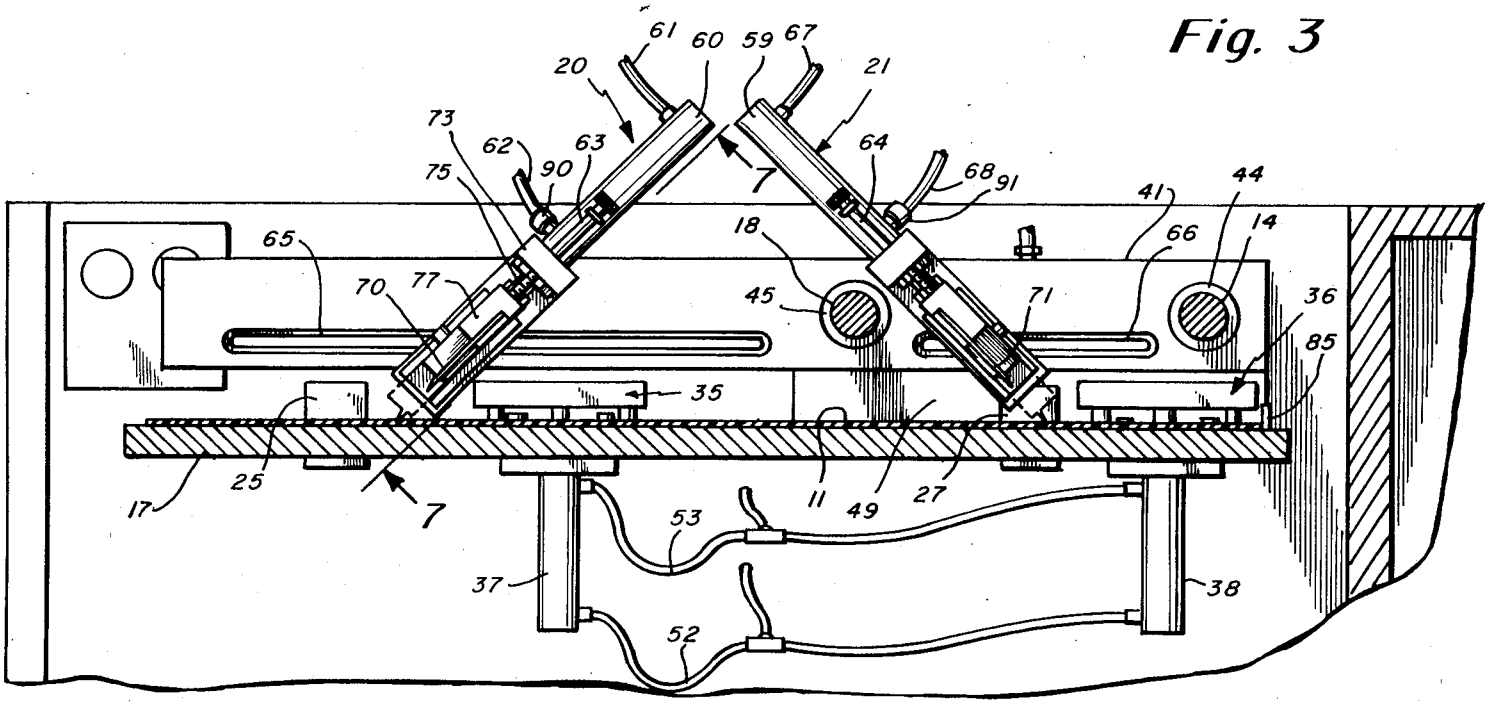
FIG. 3 is a side section view of the bevel cutter machine taken along section line 3—3 in FIG. 2.
Figure 6:
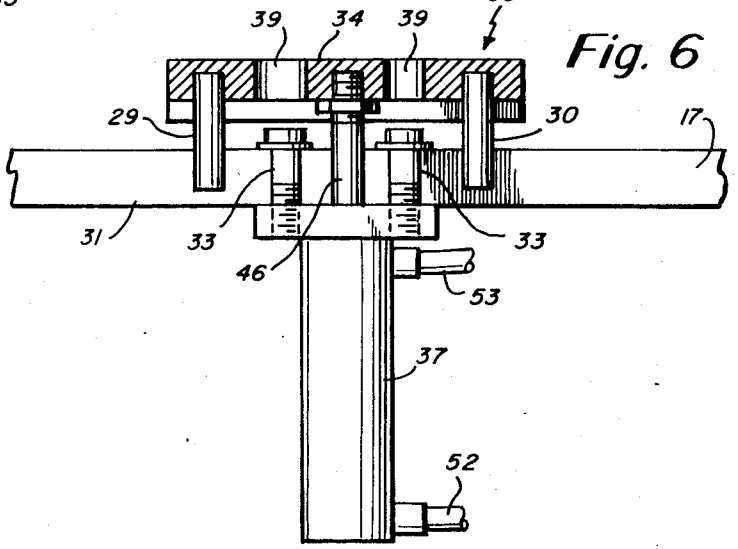
FIG. 6 is a section view of a clamp device taken along line 6—6 of FIG. 4.

In FIG. 6 clamp assembly 35 is shown. The clamp bar 34 is shown mounted above base 17 and guided to move vertically by guide posts 29 and 30. Mounted below the surface 17 by bolt 33 is clamp air cylinder 37. Piston 46 is threaded into clamp 34 with the result that movement of the piston causes movement of the clamp bar. Recesses 39 in clamp bar 34 allow the heads of bolts 33 to protrude into the clamp bar when the bar 34 is in a clamping mode. The piston is caused to movement upward and downward by air power supplied through inlet line 52 and outlet line 53. As can be seen from FIG. 2, the clamping assemblies 35 and 36 are slidably positioned within slot 31. Depending upon the size of the work piece 11, the clamping assemblies can be positioned anywhere along slot 31. In addition, FIG. 3 shows that air cylinders 37 and 38 for clamps 35 and 36, respectively, utilize common air inlet lines 52 and outlet lines 53. As a result, the clamps 35 and 36 are activated and released synchronously.

Figure 7:
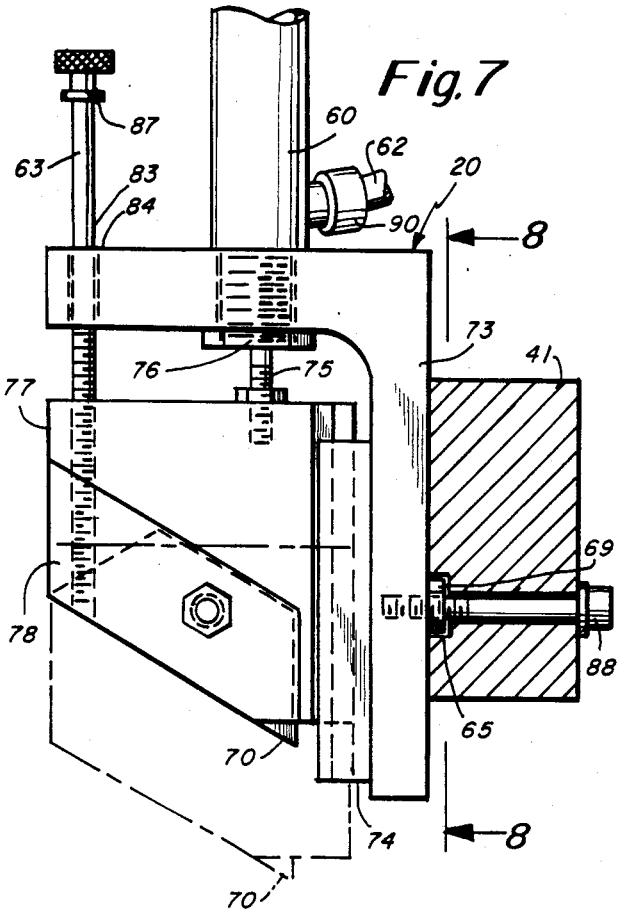
FIG. 7 is a section view of a blade holder showing the cutting blade in both cutting and at rest position along line 7-7 of FIG. 3.
Figure 8:
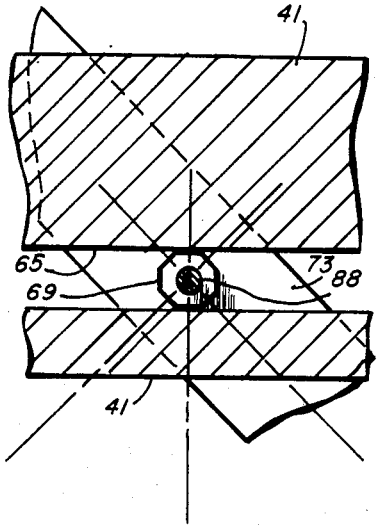
FIG. 8 is a section view of the blade holder taken along section line 8—8 of FIG. 7.

The blade holder assemblies 20 and 21 are shown in FIGS. 3, 4, 7, 8, and 9. They are mounted on long housing arm 41 within slots 65 and 66, respectively. Slots 65 and 66 allow blade holders 20 and 21 to be adjusted for a desired size of mat. The blade holders are merely moved along slots 65 and 66 and then secured by bolts 88 and 89, respectively. Further, as shown in FIG. 8, the blade holder assemblies 20 and 21 can be adjusted to cut different angles in a matte board. The hex nut 69 allows the blade holder assembly to be adjusted for three different cutting angles. It can be appreciated that other kinds of nuts and securing devices can be used to provide numerous angle settings for the blade holders 20 and 21.

Figure 4:
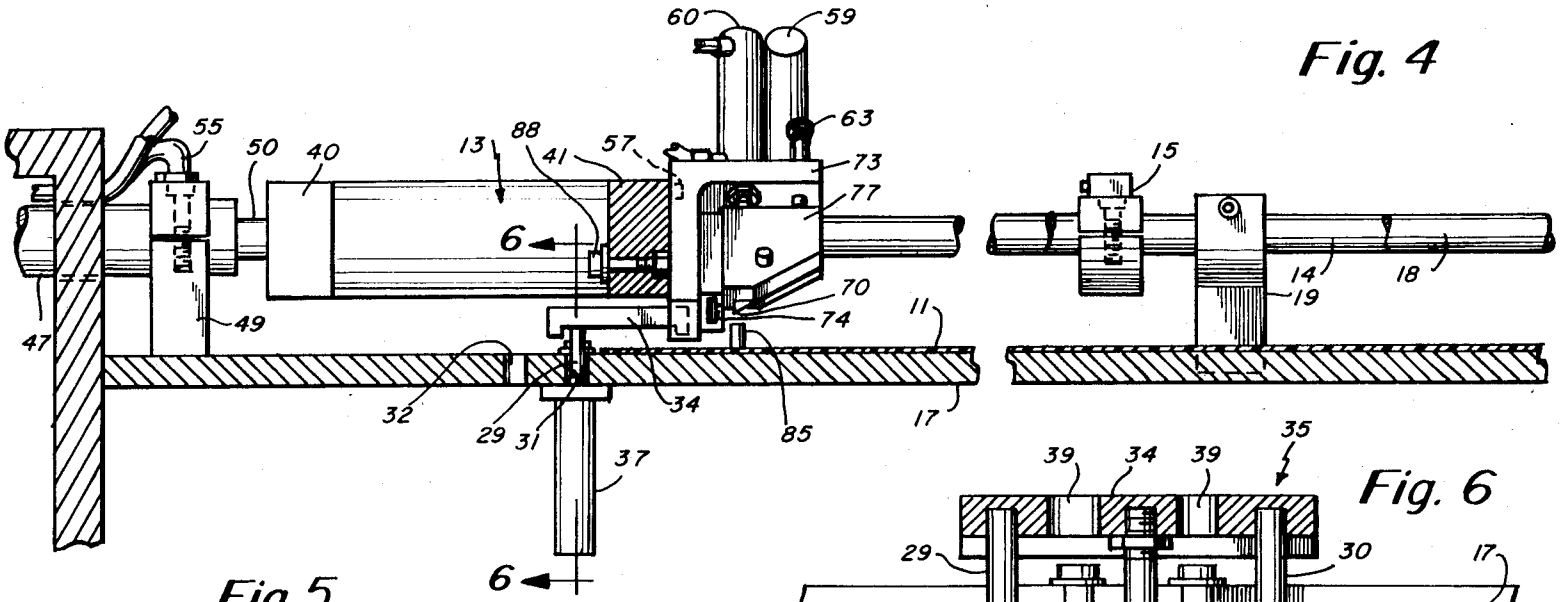
FIG. 4 is a front section view of the bevel cutter machine taken along section line 4—4 in FIG. 2.
Figure 9:
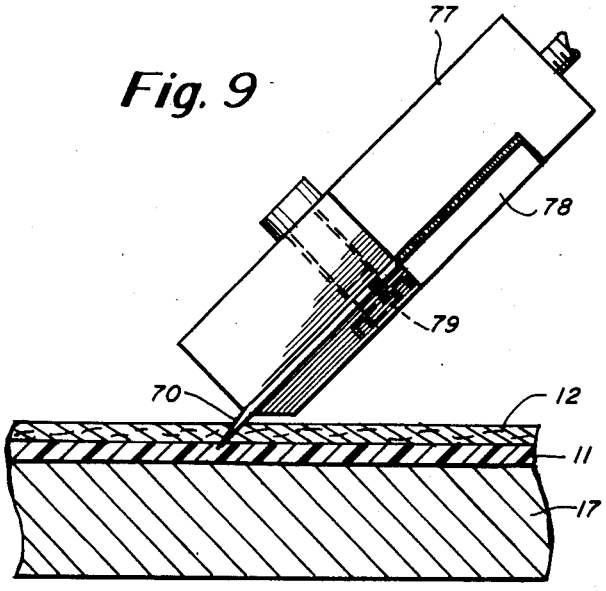
FIG. 9 is a side view of the blade holder which shows the cutting edge in its cutting position within the work piece.
Figure 10:
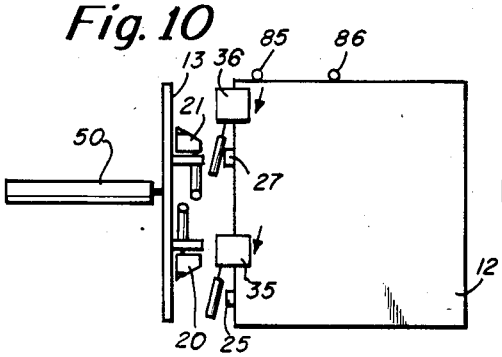
FIGS. 10-14 are an operational schematic showing the operational steps in obtaining a four-sided bevel cut from the present invention.
Figure 11:
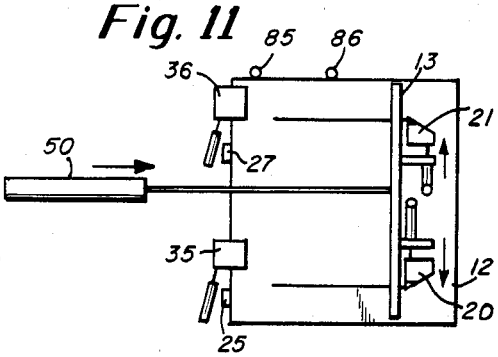

As can be seen from FIGS. 3 and 4, blade holder 20 consists of blade holder housing 73 to which is mounted air cylinder 60, slide bearing 74, and blade extension stop 63. Mounted on slide bearing 74 and contiguous with piston shaft 75 is the blade support bar 77. Blade support 77 is seen in FIG. 9 to support blade 70 in conjunction with removable blade support bar 78. Bars 77 and 78 are joined together by bolt and nut 79 and 83, respectively. In order to effect blade changes as quickly as possible, the bolt 79 is loosened, the blade is slid out along a groove (not shown) in the blade, and a new blade is inserted. Once inserted, the bolt is tightened and the machine is once again operational. Typically, blades 70 and 71 are single-sided cutting edge blades.

In FIG. 7 the blade holder assembly 20 can be clearly seen. The blade support bars 77 and 78 are shown to be supporting the blade 70. The bars are mounted within slide bearing 74 which is supported by housing 73. The threaded shaft 75 is shown inserted into bar 77 and is contiguous with piston 76 in cylinder 60. Thus, when cylinder 60 is filled with air, piston 76 causes bars 77 and 78 to move downward along slide bearing 74. The length of the downward movement is regulated by adjustments of thumb screw 63. Thumb screw 63 is passed through shaft 83 in housing 73 and is threaded into bar 77. Thus, when the piston 76 moves downward, the length of the stroke is dependent upon the length of screw 63. When the screw knurl touches the upper surface of housing 73, the piston is at its lowest position. If the desired bevel angle is to be changed, a corresponding change or adjustment must be made to the length of the stroke by adjustment of screw 63. An added benefit of this structure is that the blade 70 with support bars 77 and 78 is supported and guided at two opposing ends. The slide bearing 74 and screw 63 provide in essence substantially parallel guide for the blade 70. As such, the insertion and removal of the blade from the work piece 11 is achieved with minimum rocking motion and thus provides a very accurate and clean bevel cut.

The extent of blade insertion into work piece 12 and work surface 11 during its cutting mode is shown in FIG. 9. The blade 70 is shown to be completely through work piece 12 and partially into work surface 11. As already described above, work surface 11 is normally a self-healing plastic material which is capable of receiving numerous blade insertions with minimal damage. The stroke of piston 76 is adjusted by screw 63 so that the blade 70 does not come in contact with table surface 17. This maintains the long life of the cutting edge of the blade.

In operation, the preferred embodiment is capable of cutting two parallel bevel cuts at the same time. Extension of the cutting arm housing 13 and the addition of blade holder assemblies will result in the machine being able to cut more than the two parallel cuts already mentioned.

In FIGS. 10–14 the operation of the machine is shown schematically. The first step is to insert a matte board 12, face down, against posts 85, 86, 25, and 27. The clamp button is then pressed which pneumatically activates air cylinders 37 and 38 to pull clamp assemblies 35 and 36 down into a clamp mode. Thus, the work piece 12 is now in its proper position and clamped to work surface 11. At this time, the cut button is pressed which activates air cylinder 47 and causes piston 50 to move from left to right. Almost simultaneously with the activation of piston 50, the blade holder air cylinders 59 and 60 are activated so that the blades 70 and 71, held in blade holder assemblies 20 and 21, respectively, are caused to move toward the work piece. The slight time delay between movement of piston 50 and the downward movement of the blades is caused by adjusting the flow regulation valves 90 and 91 on air cylinder valves in cylinders 59 and 60, respectively. As the housing 13 is caused to move by piston 50, the blades 70 and 71 are caused to move downward until the blades have entered the work piece 12 at the desired beveled angle. As mentioned below, the blade gradually moves into the work piece until it cuts through to produce a total cut. Piston 50 continues to push the housing 13 with the blades 70 and 71 inserted in the work piece until the trip button 57 on long housing arm 41 comes into contact with limit switch 15. When contact is made, the piston 50 retreats and the clamps are released. When piston 50 begins its retreat, the blade cylinders 59 and 60 are vented so that the blades retreat upward to their rest position. Thus, as the piston 50 is retreating, the blades have already been withdrawn from the work piece 12 without producing a second cut over the original cut. This is, of course, highly desirable since a second stroke over the original bevel cut would damage the smooth, clean finish of the cut. In addition, it would consume valuable cycle time and slow down the overall productivity of the machine.

Figure 12:
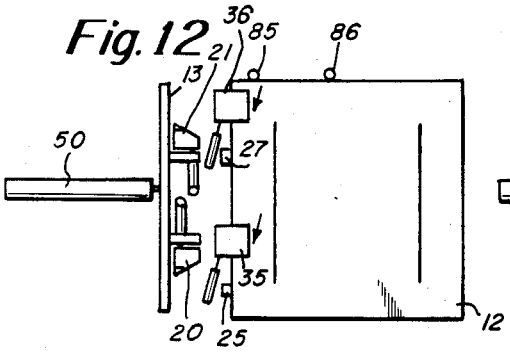
Figure 13:
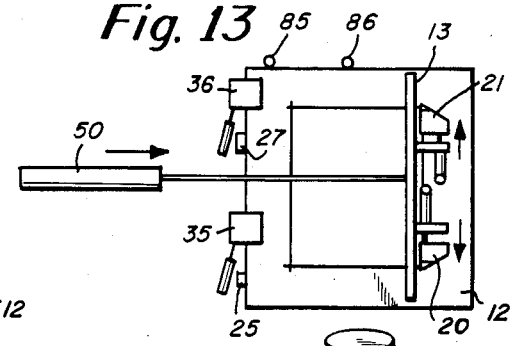
Figure 14:
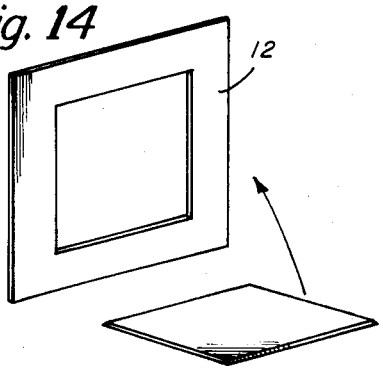

Having retreated to its rest position, the next two cuts as shown in FIGS. 12 and 13 are ready to be performed. The work piece 12 is simply rotated 90 degrees and placed against the positioning posts 85, 86, 25, and 27, and the cycle is repeated. As a result of the two sets of cuts, a beveled matte frame as shown in FIG. 14 is produced.

It can be appreciated by those skilled in the art that if the cut desired calls for uniform borders, then no adjustments are necessary between adjustment of the first and second set of cuts. However, if, as is usually the case, the cuts are for nonuniform borders, then an adjustment is needed of the positioning posts 25, 27, 85, and 86 between the first and second set of cuts. As a result, it is more productive to cut all the boards with the first cut and then adjust the machine. The boards can then be passed through for a second cut to complete the cut out. If necessary, the piston adjust screw 51 can be adjusted to lengthen or shorten the stroke of the cutting arm assembly 13.

It can also be appreciated that the clamp and cutting buttons can be reduced to a one-button system with the clamp air cylinders 37 and 38 activated first, piston 50 second, and the cutting cylinders 59 and 60 activated last. In this way, the work piece is clamped and the blades are inserted into the work piece 12 while the cutter arm assembly 13 is moving. Further, by use of known cycling techniques, the machine can have a dwell cycle in which there is a delay or dwell between the cut cycle and a new clamp cycle to afford the operator the opportunity to insert a new work piece.

It is noted that the fact that the blades are moving horizontally at the time it enters the work piece has a significant operating advantage. As already mentioned, many of the manual hand-drawn units mentioned above require a punch insertion of the blade into the work piece. This kind of insertion does not produce a clean cut but has many inherent quality problems associated with it. The cuts produced by the present machine 10 are crisp and clean because as the piston 50 causes the blades 70 and 71 to move from left to right, the blade cylinders 60 and 59 are causing downward movement of the blade. As a result, the cutting edge of blades 70 and 71 actually move in an angular path. Thus, when the cutting edge enters the work piece, it actually produces an arcuate cut in the piece 12 until it cuts through to the bottom side of the matte board. In order to conceal the cutting arc in work piece 12, the work piece 12 is placed face down on the work surface 11. Therefore, the blades 70 and 71 enter the back side of the work piece 12 with the result that the arc cuts are never seen by the consumer. In addition, the arc cut is gradual with the result that there is virtually no color draw caused by the blade. In addition, the location of the cut through to the front surface can be calibrated by adjustment of flow valves 90 and 91 to insure that the corner cuts are neat and clean.

Figure 15:
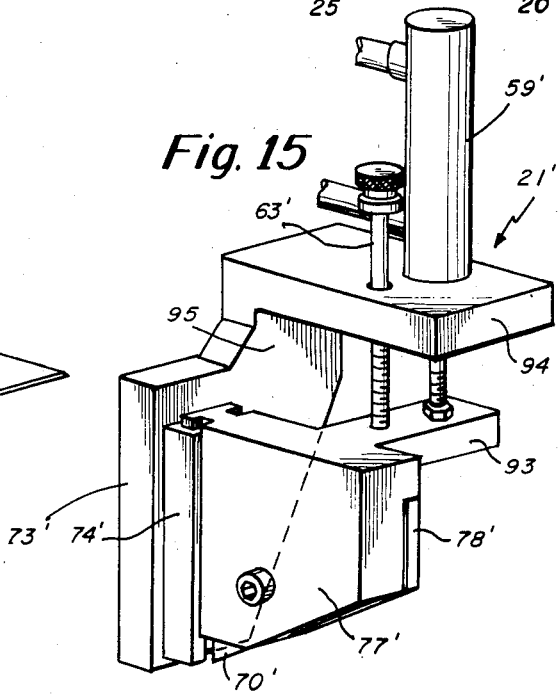
FIG. 15 is a perspective view of an alternate embodiment of a blade holder assembly.

FIG. 15 shows a perspective view of another embodiment of blade holder assembly 21. Shown is blade holder assembly 21' having air cylinder 59', blade extension stop 63', and slide bearing 74'. Assembly 21' is configured so that offset platform 94 is positioned over offset tab 93 so that the air cylinder 59' and stop 63' are vertically offset from blade support bar 77' and blade 70'. As a result, blade holder assemblies of this kind can be moved closer together without their respective air cylinders touching each other. The assemblies can thus be adjusted to cut fairly small openings in matte board for a wide variety of bevel angle cuts.

What is claimed is:

1. A machine for bevel cutting a planar work piece having a front face and back face, said machine comprising:

a work surface for supporting said work piece, a cutting blade, a blade holder for holding said cutting blade at an angle with respect to said work piece back face, means for positioning and securing said work piece to said work surface so that said work piece can be quickly and easily positioned with respect to said cutting blade, said means for positioning and securing said work piece to said work surface comprising at least one power-activated clamping means contiguous with said work surface and at least one guide post mounted on said work surface and positioned to guide adjacent edges of a four-sided work piece, first means for moving said cutting blade into and out of said work piece at a first speed along said blade holder, guide means for constraining said blade holder to move in a direction parallel to the plane of said work piece, second means for moving said blade holder at a second speed along said guide means, and means for simultaneously operating said first and second moving means, the magnitude of said first speed being related to the magnitude of said second speed so that said cutting blade enters said work piece back face at an entry point, moves through said work piece at an angle to said work piece front face and exits said front face at a point displaced from said entry point in a direction parallel to said guide means.

2. A machine for bevel cutting a planar work piece according to claim 1 wherein said clamping means comprises a clamping bar positioned above said work surface, an arm member connected to said clamping bar; power means connected to said arm member so that actuation of said power means moves said clamping bar toward or away from said work surface.

3. A machine for bevel cutting a planar work piece having a front face and back face, said machine comprising:

a work surface means for supporting said work piece in a stationary position with respect to said work surface;

a cutting blade;

a blade holder for holding said cutting blade at an angle with respect to said work piece back face, said blade holder comprising a bracket arm; a blade support bar; a blade extension post having a stop at a first end and passing through said bracket arm so as to be engaged in said blade support bar at a second end; a slide bearing engaged in a sliding relationship with said blade support bar; a shaft engaged with said blade support bar; and power means connected to said shaft whereby said shaft is caused to move said blade support bar along said bearing until said stop at said first end of said blade extension post engages said bracker arm;

first means for moving said cutting blade into and out of said work piece at a first speed along said blade holder, guide means for constraining said blade holder to move in a direction parallel to the plane of said work piece, second means for moving said blade holder at a second speed along said guide means, and means for simultaneously operating said first and second moving means, the magnitude of said first speed being related to the magnitude of said second speed so that said cutting blade enters said work piece back face at an entry point, moves through said work piece at an angle to said work piece front face and exits said front face at a point displaced from said entry point in a direction parallel to said guide means.

4. A machine for bevel cutting a planar work piece having a front face and back face, said machine comprising:

a work surface means for supporting said work piece in a stationary position with respect to said work surface;

a cutting blade;

a blade holder for holding said cutting blade at an angle with respect to said work piece back face, said blade holder comprising a bracket arm; a blade support bar; a platform contiguous with said blade support bar and configured in a 90 degree relationship to said blade support bar; a blade extension post having a stop at a first end and passing through said bracket arm so as to be engaged in said platform at a second end; a slide bearing engaged in a sliding relationship with said blade support bar; a shaft engaged with said platform; and power means connected to said shaft whereby said shaft is caused to move said platform and said blade support bar along said bearing until said first end of said blade extension post engages said bracket arm;

first means for moving said cutting blade into and out of said work piece at a first speed along said blade holder, guide means for constraining said blade holder to move in a direction parallel to the plane of said work piece, second means for moving said blade holder at a second speed along said guide means, and means for simultaneously operating said first and second moving means, the magnitude of said first speed being related to the magnitude of said second speed so that said cutting blade enters said work piece back face at an entry point, moves through said work piece at an angle to said work piece front face and exits said front face at a point displaced from said entry point in a direction parallel to said guide means.

5. A machine for bevel cutting a planar work piece, such as paper or other soft materials, having a front face and a back face, said machine comprising:

a worktable means for supporting said work piece in a stationary position with respect to said worktable, a cutting blade, a blade holder for holding said cutting blade at an angle with respect to said work piece back face, a first pneumatic cylinder for moving said cutting blade into and out of said work piece along said blade holder, first flow regulator means for controlling air pressure applied to said first cylinder so that said cylinder moves said cutting knife along said blade holder, a guide bar for constraining said blade holder to move in a direction parallel to the plane of said work piece, a second pneumatic cylinder for moving said blade holder, second flow regulator means for controlling air pressure applied to said second cylinder so that said second cylinder moves said blade holder along said guide bar, and means for simultaneously applying air to said first and second flow regulators, said first and second flow regulators being adjusted in a manner such that said cutting blade enters said work piece back face at an entry point, moves through said work piece at an angle to said work piece front face and exits said front face at a point displaced from said entry point in a direction parallel to said guide means.

6. A machine for bevel cutting a planar work piece according to claim 5 further comprising:

a second cutting blade, a second blade holder for holding said second cutting blade at an angle with respect to said work piece back face, a rigid housing arm connecting said blade holder and said second blade holder at a predetermined distance so that said cutting blade and said second cutting blade are held parallel to each other, said second pneumatic cylinder being connected to said housing arm so that said blade holder and said second blade holder move simultaneously, a third pneumatic cylinder for moving said second cutting blade into and out of said work piece along said blade holder, third flow regulator means for controlling air pressure applied to said third cylinder so that said third cylinder moves said second cutting knife along said second blade holder, means for simultaneously applying air to said second and third flow regulators, said second and third flow regulators being adjusted in a manner such that said second cutting blade enters said work piece back face at an entry point, moves through said work piece at an angle to said work piece front face and exits said front face at a point displaced from said entry point in a direction parallel to said guide means and said cutting blade and said second cutting blade produce parallel cuts in said work piece.

7. A machine for bevel cutting a planar work piece, such as paper or other soft materials according to claim 6 further comprising, a clamp attached to said worktable for securing said work piece to said worktable, a fourth pneumatic cylinder for operating said clamp and means for applying air to said fourth pneumatic cylinder prior to movement of said blade holders to secure said work piece to said worktable before cuts are made.

8. A machine for bevel cutting a planar work piece, such as paper or other soft materials according to claim 7 further comprising a limit switch mounted on said guide bar for stopping the movement of said housing arm after said arm has traveled a predetermined distance along said guide bar.

* * * * *